United States Patent [19]

Grinde

[11] 4,426,961

[45] Jan. 24, 1984

[54] STARTING ARRANGEMENT FOR INTERNAL COMBUSTION ENGINE

[75] Inventor: James E. Grinde, Anoka, Minn.

[73] Assignee: Yamaha Hatsudoki Kabushiki Kaisha, Iwata, Japan

[21] Appl. No.: 312,334

[22] Filed: Oct. 16, 1981

[51] Int. Cl.[3] ..... E02N 17/00

[52] U.S. Cl. ..... 123/179 SE; 123/185 A; 123/185 B; 123/185 BA

[58] Field of Search ..... 123/179 SE, 179 CC, 123/185 R, 185 A, 185 B, 185 BA, 185 BB; 74/6

[56] References Cited

U.S. PATENT DOCUMENTS

| | | | |
|---|---|---|---|
| 2,869,531 | 1/1959 | Cedermark | 123/185 BA |
| 3,094,109 | 6/1963 | Effinger, Jr. | 123/179 SE |
| 3,190,276 | 6/1965 | Diggs | 123/179 SE |
| 3,366,099 | 1/1968 | Kaufman | 74/6 |

FOREIGN PATENT DOCUMENTS

| | | | |
|---|---|---|---|
| 1207711 | 12/1965 | Fed. Rep. of Germany | 123/179 SE |
| 2478240 | 9/1981 | France | 74/6 |
| 5545081 | 7/1975 | Japan . | |
| 55-51950 | 4/1980 | Japan | 123/185 BB |

*Primary Examiner*—Parshotam S. Lall
*Attorney, Agent, or Firm*—Ernest A. Beutler

[57] ABSTRACT

A compact recoil starting arrangement for an internal combustion engine wherein the recoil starter mechanism is interposed between a wall of the engine through which the engine output shaft extends and a driving element that is affixed to the outer end of the engine output shaft.

4 Claims, 2 Drawing Figures

STARTING ARRANGEMENT FOR INTERNAL COMBUSTION ENGINE

BACKGROUND OF THE INVENTION

This invention relates to a starting arrangement for internal combustion engines and more particularly to an improved, compact pull-type starter arrangement for such engines.

As is well known, many small internal combustion engine applications employ pull-type or recoil starters. Conventionally such recoil starters have been mounted at the outer end of the crankshaft and normally on its flywheel end. Such arrangements add significantly to the size of the engine and further to the weight due to the use of enclosing elements such as starter cups and the associated bolts for attaching them to the flywheel. Because of this, there may be some applications where it is impossible to employ an internal combustion engine even though it might be particularly desirable. Furthermore, the geometic and weight requirements of previously employed recoil starters have added to the cost of the application.

It is, therefore, a principal object of this invention to provide an improved, compact recoil starter for an internal combustion engine.

It is a further object of this invention to provide an improved recoil starting arrangement for an internal combustion engine that permits a compact configuration, reduces cost and also reduces weight.

SUMMARY OF THE INVENTION

This invention is adapted to be embodied in a recoil starting arrangement for an internal combustion engine having an engine housing, an output shaft extending through a wall of the engine housing and a driven element affixed to the output shaft contiguous to the housing wall. In accordance with this invention, a recoil starting mechanism is interposed between the wall and the driven element and cooperates with the output shaft for pull starting of the engine.

DETAILED DESCRIPTION OF THE PREFERRED EMBODIMENT

Figure 1:
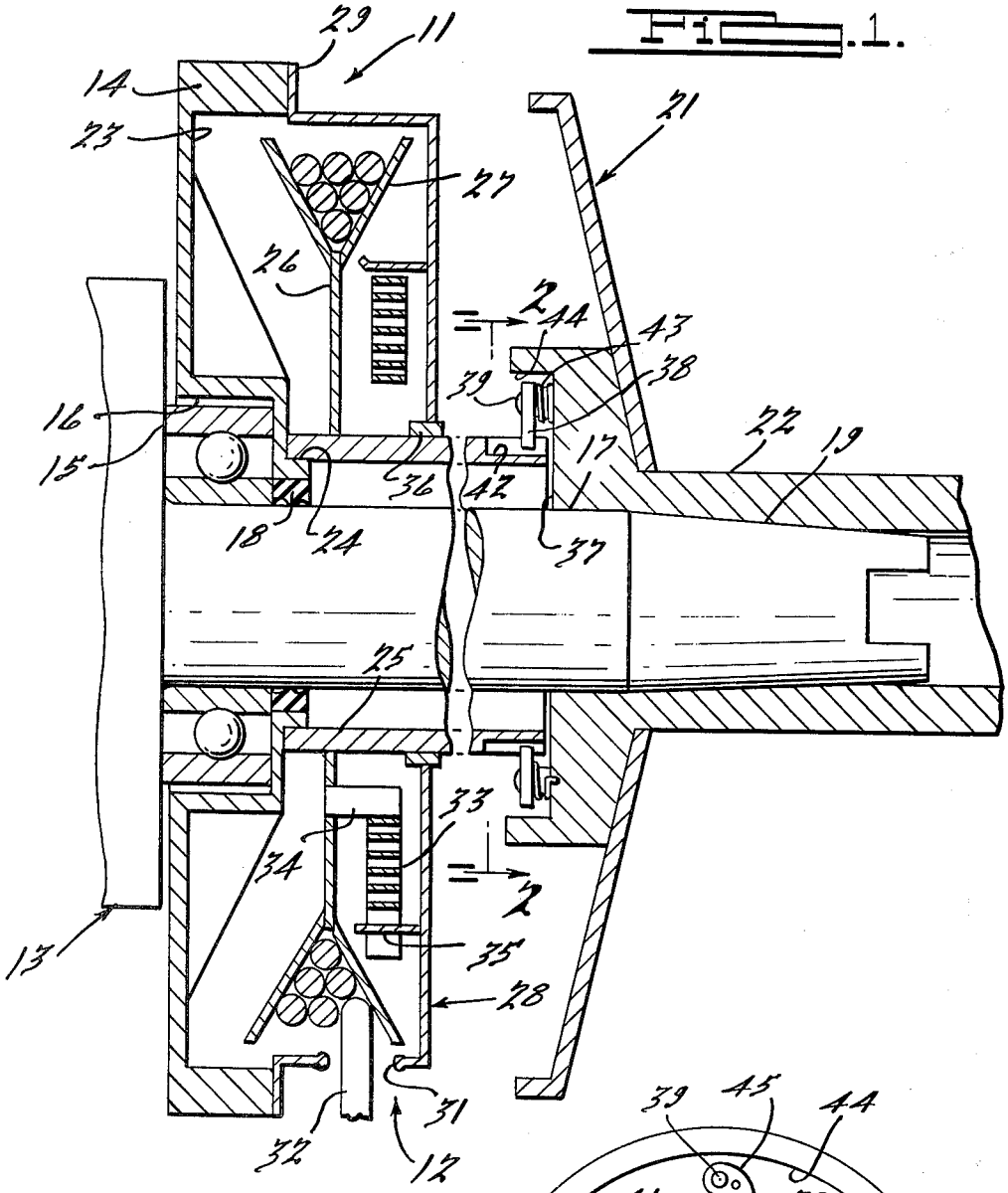
FIG. 1 is a cross-sectional view taken through the output shaft of a internal combustion engine constructed in accordance with this invention.
Figure 2:
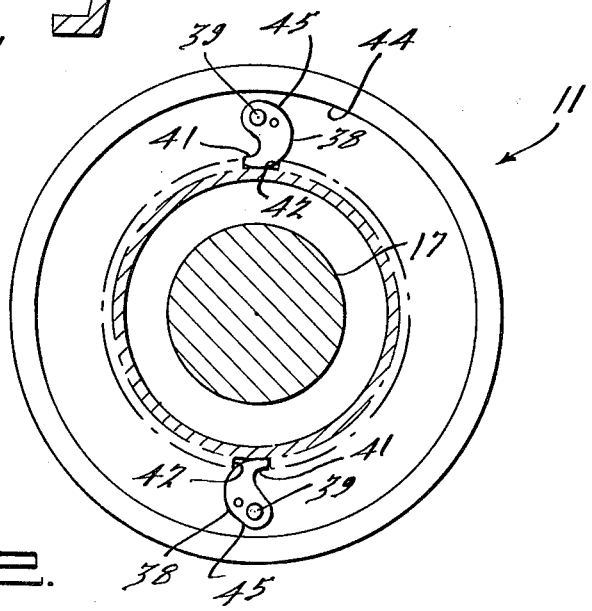
FIG. 2 is a cross-sectional view taken along the line 2—2 of FIG. 1.

An internal combustion engine have a recoil starter constructed in accordance with this invention is identified generally by the reference numeral 11. Inasmuch as the invention is directed toward the construction and location of the recoil starter mechanism, indicated generally by the reference numeral 12, only those portions of the engine 11 as are necessary to understand the invention have been illustrated. Also, it is to be understood that this invention is adapted for use with engines having a wide variety of contructional types such as reciprocating, rotating, four-cycle, two-cycle, and so forth. The invention has particular utility in conjunction with small engines wherein a compact arrangement is desired in order to permit utilization for applications where the cumbersome size of previously employed recoil starter mechanisms have not permitted the use of internal combustion engines or have compromised the final design due to their large size.

The engine 11 includes an output shaft 13 which has one of its ends journaled in a wall 14 of a portion of the housing of the engine 11 by means of a ball bearing assembly 15. The bearing assembly 15 is pressed into a suitable opening 16 formed in the wall 14. The output shaft 13 has a portion 17 which extends outwardly of the wall 14 for connection to a driven element, as will be described. A seal 18 engages the wall 14 and shaft portion 17 so as protect the bearing 15 and internal components of the engine 11 from the ingress of foreign material.

The outer end of the shaft portion 17 is tapered, as at 19, so as to permit the attachment of a driven element, indicated generally by the reference numeral 21. This invention is particularly adapted for use with small self-propelled vehicles, although as has been noted the invention is not so limited, and for this purpose the driven element 21 constitutes the driving sheave of a variable belt drive clutch. The sheave 21 has a hub portion 22 that is affixed to the tapered shaft portion 19 in any known manner.

The engine wall 14 defines a recess 23 which extends circumferentially around the portion which supports the bearing 15. A shoulder 24 is formed by an outwardly extending portion of the wall 14 which portion also receives the seal 18. A starter hub 25 is journaled at one of its ends upon the shoulder 24. A starter rope pulley 26 is affixed to the hub 25 and has its pulley portion 27 extending partially into the recess 23. A recoil cover and spring housing, indicated generally by the reference numeral 28, has an upstanding flange 29 that is affixed to the wall 14 by means of one or more threaded fasteners (not shown). The cover 28 encloses the rope pulley 26 and is formed with an opening 31 through which the end of the starter rope 32 extends. A handle (not shown) is affixed in a known manner to the outer end of the starter rope 32 and is accessible between the drive sheave 21 and engine housing 14 so as to permit pull starting, as will be described.

A torsional return spring 33 is enclosed within the cover 28 and has one of its ends affixed to a tang 34 affixed to the rope pulley 26. The other end of the spring 33 is connected to a tang 35 which extends inwardly from the cover 28 so that the spring 33 will be loaded when the starter rope 32 is pulled to rotate the rope pulley 26 and return it and the starter rope 32 when the starter rope is released, as is well known.

The cover 26 carries a guide support bushing 36 which cooperates with the housing wall shoulder 24 to complete the rotational support for the starter hub 25. The starter hub 25 extends outwardly beyond the bushing 26 and terminates adjacent a recess 37 formed in the side of the hub 22 adjacent the engine wall 14.

A plurality of starter pawls 38 are pivotally supported on pins 39 which are, in turn, affixed to the hub 22 within the recess 37. The pawls 38 have ends 41 which are normally urged into engagement with notches 42 formed in the outer end of the starter hub 25 by means of torsional pawl springs 43. The recess 37 is bounded by a cylindrical wall 44 which forms a stop for an arcuate surface 45 of the pawls 38, as will be described.

The drawings illustrate the starter mechanism as it appears when the engine 11 is not running. As has been noted under this condition the springs 43 will rotate the pawls 38 so that their ends 41 are in engagement with the notches 42 so that the engine 11 and starter mechanism 12 are predisposed for starting operation. If the handle on the end of the rope is grasped and pulled, the rope 32 will unwind from the rope pulley 26 and drive this pulley and the starter hub 25. The engagement of the pawl ends 41 in the notches 42 will effect rotation of the clutch hub 22 and coupled engine output shaft 13. When the engine 11 fires and begins to run, its output shaft 13 will overrun the starter hub 25 and the centrifical force on the pawls 38 will cause them to rotate about their supporting pivot pins 39 so that their cam surfaces 45 will rotate into engagement with the clutch hub surface 44. The palls 38 will be held in this position by the centrifical force to load the springs 43 and maintain the pawl ends 41 clear of the notches 42. Release of the starter rope 32 will cause the spring 33 to rewind the starter rope on the puller portion 27. When the engine 11 is stopped, the pawl springs 43 will again rotate the pawls 38 to their starter position as shown in the figures.

It should be readily apparent that the interpositioning of the starting mechanism 21 between the engine wall 14 and driven element 21 provides an extremely compact arrangement without adversely effecting the starting capabilities of the engine. Also, the compact construction reduces weight and, accordingly, the cost of the associated engine. This compact arrangement permits engine applications previously not possible.

Although certain modifications of the structure and its application have been described, still other changes in construction and application may be made without departing from the spirit and scope of the invention as defined by the appended claims.

What is claimed is:

1. In a recoil starting arrangement for an internal combustion engine of a powered vehicle, said engine having an engine housing including a non-rotatable engine wall, an output shaft extending through said wall of said engine housing, said wall having an outwardly extending projection, bearing means supported within said projection and journaling said output shaft, and a driven element affixed to said output shaft contiguous to said wall and outwardly of said projection, the improvement comprising a recoil starter mechanism interposed between said wall and said driven element and cooperatable with said output shaft for pull starting of said engine, said engine wall defining a recess extending around said wall projection and the extending portion of the output shaft, the starting mechanism including a rope pulley extending in part into said engine wall recess, a cover affixed to said wall and enclosing said recess and said rope pulley, said wall defining a shoulder extending around the output shaft and disposed radially inwardly of the wall recess and outwardly from said projection, said rope pulley being affixed to a starter hub rotatably supported at one end thereof by said wall shoulder, said cover defining a central opening encircling the starter hub, and a bushing interposed between said cover opening and said starter hub for journaling said starter hub.

2. A recoil starting arrangement as set forth in claim 1 wherein the recoil starting mechanism includes a plurality of spring biased pawls for transmitting rotation from a hand rotated element and the engine output shaft and for permitting overrunning of said output shaft relative to said hand rotated element.

3. A recoil starting arrangement as set forth in claim 2 wherein the pawls are pivotally supported by the driven element.

4. A recoil starting arrangement as set forth in claim 3 wherein the starter hub has a portion disposed contiguous to the driven element, said starter hub portion being formed with a plurality of recesses therein, said pawls being biased toward engagement with said starter hub recess for effecting a driving connection between said starter hub and said driven element.

* * * * *